United States Patent [19]

Shaffer

[11] Patent Number: 4,927,398

[45] Date of Patent: May 22, 1990

[54] INCANDESCENT LAMPS INCLUDING A COMBINED GETTER

[75] Inventor: John W. Shaffer, Montoursville, Pa.

[73] Assignee: GTE Products Corporation, Danvers, Mass.

[21] Appl. No.: 409,979

[22] Filed: Sep. 19, 1989

Related U.S. Application Data

[63] Continuation of Ser. No. 287,769, Dec. 21, 1988, abandoned, which is a continuation-in-part of Ser. No. 287,574, Dec. 16, 1988, which is a continuation of Ser. No. 153,863, Feb. 9, 1988, abandoned.

[51] Int. Cl.[5] ..... H01J 9/38

[52] U.S. Cl. ..... 445/9; 445/55

[58] Field of Search ..... 445/9, 38, 41, 53, 55; 313/557, 562

[56] References Cited

U.S. PATENT DOCUMENTS

| | | | |
|---|---|---|---|
| Re. 31,388 | 9/1983 | Hellier et al. . | |
| 1,166,464 | 1/1916 | Liebmann | 445/9 |
| 1,269,520 | 6/1918 | Blau | 445/9 |
| 1,560,981 | 11/1925 | De Graaff | 445/9 |
| 1,600,203 | 9/1926 | Campbell . | |
| 1,648,677 | 11/1927 | De Boer | 313/557 |
| 1,944,825 | 12/1929 | Millner | 445/55 |
| 1,958,967 | 5/1934 | Kniepen . | |
| 3,475,072 | 10/1969 | Graves | 316/6 |
| 3,510,189 | 5/1970 | Larson | 445/9 |
| 3,585,435 | 6/1971 | T'Jampens | 313/557 |
| 4,005,324 | 1/1977 | Dolenga | 445/53 |
| 4,024,425 | 5/1977 | Higashi | 313/562 |
| 4,032,808 | 6/1977 | Kischio | 313/178 |
| 4,099,081 | 7/1978 | Ainsworth | 313/174 |
| 4,213,662 | 7/1980 | Giller | 445/53 |
| 4,342,662 | 8/1982 | Kimura . | |
| 4,349,394 | 9/1982 | Wei | 437/12 |
| 4,407,656 | 10/1983 | Hofer . | |
| 4,668,304 | 5/1987 | Benjamin et al. . | |
| 4,727,286 | 2/1988 | Keenan | 313/557 |
| 4,810,221 | 3/1989 | Shaffer | 445/9 |

FOREIGN PATENT DOCUMENTS 2409416 2/1974 Fed. Rep. of Germany .

*Primary Examiner*—Kurt Rowan

*Attorney, Agent, or Firm*—Martha Ann Finnegan

[57] ABSTRACT

This invention relates to incandescent lamps and more particularly to the gettering of such lamps. In accordance with the present invention, there is provided an incandescent lamp comprising an envelope, a tungsten filament mounted within the envelope, a fill gas, and a getter comprising silane and phosphorus. In accordance with another aspect of the present invention, there is provided a method of gettering an incandescent lamp. The method comprises providing a getter comprising phosphorus and silane in an unsealed lamp envelope; sealing the lamp envelope; and activating the phosphorus source and silane located within the sealed envelope.

23 Claims, No Drawings

INCANDESCENT LAMPS INCLUDING A COMBINED GETTER

This is a continuation of co-pending application Ser. No. 287,769 filed on Dec. 21, 1988, now abandoned, which is a continuation-in-part application of U.S. patent application Ser. No. 287,574, now allowed filed 16 Dec. 1988, which is a continuation of Ser. No. 153,863 now abandoned of John W. Shaffer, filed Feb. 9, 1988 for "Improved Method For Gettering Incandescent Lamps", the disclosure of which is hereby incorporated herein by reference.

TECHNICAL FIELD OF THE INVENTION

The present invention relates to incandescent lamps, and more particularly to the gettering of such lamps.

BACKGROUND OF THE INVENTION

The operating life of an incandescent lamp is greatly shortened by the presence of oxygen, carbon dioxide, and/or water vapor in the internal lamp atmosphere. Water vapor is particularly harmful because even trace amounts "catalyze" the evaporation of the tungsten filament coil by means of the well known "water cycle."

In the water cycle, the temperature at the tungsten coil is thermally sufficient to decompose water vapor into hydrogen and oxygen. The resulting oxygen reacts with the tungsten in the coil to form volatile oxides which migrate to cooler parts of the lamp and condense. These oxide deposits are reduced by the gaseous hydrogen to yield black metallic tungsten and reformed water, which causes the cycle to repeat.

The problems introduced by excess oxygen in incandescent lamps are likewise well known. For example, in the tungsten-halogen cycle, oxygen is the primary agent of attack on the tungsten filament. This attack may result in etching and dendritic growth, and usually causes early filament failure. While an extremely small amount of oxygen is commonly accepted as a necessary constituent in the lamp, the amount which ends up in a finished tungsten-halogen capsule is generally recognized as being extremely variable and is always considered to be excessive. The presence of this "necessary constituent" has long been recognized as a major impediment to the fabrication of longer lived and more consistently performing tungsten-halogen lamps.

A commonly utilized solution to the oxygen problem in tungsten-halogen lamps is the introduction of one or more compounds into the lamp which will remove the excess oxygen and prevent its participation in the tungsten-halogen cycle. Such compounds are commonly referred to as "oxygen getters" or simply "getters".

Various oxygen getters and/or gettering systems have been used previously. For example, metallic getters such as tantalum, zirconium, niobium, copper, hafnium, titanium, aluminum, or various combinations thereof, have been employed as oxygen getters. In application, metallic getters may be attached to a portion of the filament mount within the lamp, e.g., in the form of a crimped piece of metal. These metal getters may alternatively be incorporated as an alloy in the molybdenum leads which support the filament within the lamp.

U.S. Pat. No. 4,305,017 describes the use of the above-identified metals together with precious metals such as palladium, platinum and gold as oxygen getters.

Metal flags, such as those described in the '017 patent, tend to be difficult and expensive to attach to the internal structure of a tungsten-halogen lamp. Also, some metallic getters that are used in halogen-free incandescent lamps are not applicable for use in tungsten halogen lamps because they will react with the halogen and terminate the desired halogen cycle. Likewise, the fabrication of specialized getter alloys can also add considerably to the cost of manufacturing a tungsten-halogen lamp. In addition, in certain lamp types, it is desirable for the getter to be present across the entire range of locations within the lamp. Such positioning is impossible with metallic flag getters, and/or metal alloy gettering systems, which are generally limited to specific discrete locations.

Another commonly used oxygen getter for incandescent lamps is phosphorus. Phosphorus oxides which are formed by the gettering of oxygen are volatile, even at the cold spot temperatures found in hot operating incandescent lamps, including tungsten-halogen lamps.

Another oxygen getter which has been employed in incandescent lamps is the carbon getter. Carbon getters may be introduced to the lamp as part of a hydrogenated hydrocarbon gas or as carbon monoxide. However, in addition to deleteriously affecting filament life in certain lamp types, carbon has failed to perform as expected as an oxygen getter.

Yet another oxygen gettering system is described in U.S. Pat. No. 1,944,825. This patent teaches and claims the use of various gaseous fluoride compounds having water-absorbing properties. The list of fluoride compounds includes $SiF_4$, $BF_3$, $AsF_3$, $PF_3$, and salts thereof.

New gettering systems are constantly being developed. The present invention represents another such advance in this art.

SUMMARY OF THE INVENTION

It has been surprisingly found that a beneficial synergistic effect occurs from including a getter comprising silane ($SiH_4$) and phosphorus (P) in incandescent lamps.

In accordance with the present invention, there is provided an incandescent lamp comprising an envelope, a tungsten filament mounted within the envelope, a fill gas, and a getter comprising silane and phosphorus.

In accordance with another aspect of the present invention, there is provided a method of gettering an incandescent lamp. The method comprises providing a getter comprising phosphorus and silane in an unsealed lamp envelope; sealing the lamp envelope; and activating the phosphorus and silane located within the sealed envelope.

During the getter activation step of the present method, the phosphorus and silane are "activated" to combine with the impurities within the sealed envelope.

The getter "activation" conditions should be chosen such that the getter does not decompose prior to performing the desired gettering function. In fact, when temperatures sufficient to cause premature decomposition of the getter are employed, the getter composition recited above fail to function.

During the getter activation step, the phosphorus and silane react with residual impurities such as oxygen, water, etc., present in the sealed envelope, forming by-products including silicon dioxide, and phosphorus oxide.

For a better understanding of the present invention, together with other and further advantages and capabilities thereof, reference is made to the following detailed description and the claims appended hereto.

DETAILED DESCRIPTION

The present invention is directed to an incandescent lamp including an improved getter and a method for gettering such a lamp.

Use of getter comprising silane and phosphorus, in accordance with the present invention, provides incandescent lamps having a lamp life that is dramatically superior to that attainable by a lamp including a getter comprising either silane or phosphorus, separately.

The present invention is particularly advantageous when used in tungsten halogen incandescent lamps and the fabrication thereof.

Incandescent lamps, including tungsten halogen incandescent lamps, are well known in the lighting art. Such lamps typically include an hermetically sealed light pervious envelope, such as quartz or hard glass, containing a fill gas including an inert gas. Typical fill gases for a tungsten halogen incandescent lamp further include a halogen and may further include hydrogen. The halogen in the fill gas may be used in its diatomic elemental form or as a volatile halide compound, such as a hydrogen halide compound. When the halogen is supplied to the lamp as a hydrogen halide, the hydrogen halide compound also furnishes hydrogen gas to the fill gas. The principal function of the fill gas in incandescent lamps is to retard evaporation of the coil. In some lamps the fill gas may perform the additional secondary function of suppressing the arc. The envelope also includes a tungsten filament wire or tungsten coil which is in connection with lead-in wires sealed into and extending internally and externally of the lamp envelope. Such lead-in wires may extend from opposite ends of the envelope (double-ended lamp) or from the same end of the envelope (single-ended lamp). Such lamps may further be enclosed within an outer envelope or a parabolic reflector and a lens.

The incandescent lamps of the present invention include a getter comprising silane and phosphorus. The phosphorus may be initially included in the lamp as elemental phosphorus powder. For example, the phosphorus can be deposited in the lamp, on either the filament mount and/or the coil itself, e.g., by dipping the filament or coil mount in a suspension of red phosphorus or $P_3N_5$ in a suitable solvent. Alternatively, phosphorus can be deposited on the filament by evaporative coating with red phosphorus.

The phosphorus need not be introduced directly into the lamp in its elemental form. Alternatively, phosphorus may be generated in situ. For example, phosphorus can be produced in the envelope from phosphine ($PH_3$) gas by thermal decomposition of phsophine into phosphorus and hydrogen. Such thermal decomposition may be effected by the heat of the coil at lamp light-up.

As used herein, "phosphorus source" means phosphorus and phosphorus containing materials having physical and chemical properties suitable for generating phosphorus in situ, e.g., phosphine gas.

Preferably the getter of the present invention includes silane in an amount from approximately 0.01 to 0.5 percent by volume of the fill gas and from approximately $5\times10^{-5}$ to approximately $5\times10^{-9}$ moles of phosphorus per cubic centimeter (internal volume of capsule). Most preferably, the combined getter includes approximately 0.1 to approximately 0.2 volume percent silane and from approximately $5\times10^{-6}$ to approximately $5\times10^{-8}$ moles of phsophorus per cubic centimeter (internal volume of capsule).

In the method of the present invention, the unsealed envelope is provided with a getter comprising phosphorus and silane. The getter can be provided in the unsealed envelope by various techniques. For example, silane and a gaseous phosphorus source can be introduced into the unsealed envelope with the fill gas in a single step by, for example, introducing a fill gas also including silane and a phosphorus source, e.g., phosphine ($PH_3$) gas, into the unsealed envelope, subsequent to which, the phosphine is converted into phosphorus and hydrogen during the getter activation step.

Alternatively, the phosphorus can be introduced into the envelope before the introduction of silane and the fill gas. This can be accomplished by introducing a phosphorus source into the unsealed envelope and converting it into elemental phosphorus, by, e.g, thermally decomposing the phosphine into phosphorus and hydrogen by lighting up the filament or coil, following which decomposition by-products are pumped out of the envelope, and the silane and fill gas are then introduced into the unsealed envelope, after which the envelope is sealed or "tipped off". Alternatively, elemental phosphorus may be included in the unsealed envelope as a coating on the filament or coil by conventional techniques with the silane being introduced with the fill gas.

After the phosphorus (or phosphorus source), silane, and fill gas are introduced into the envelope and the envelope is sealed, the getter located within the sealed envelope is activated. Such activation may be accomplished by heating the sealed envelope at a temperature and for sufficient time to activate the gettering properties of the silane and phosphorus before the getter decomposes. Preferably the temperature is from about 100 to about 500 degrees C. For such temperature range, the heating period is preferably from about 1 minute to about 60 minutes.

The activation of the getter may also be carried out as a two step process by: (1) permitting the lamp including the silane and phosphorus (or phosphorus source) to age, without heating, e.g., at room temperature, for a period of time sufficient to permit the silane to react with the oxygen and/or water vapor impurities in the envelope; and (2) heating the phosphorus (or phosphorus source) in the "aged" lamp to activate the phosphorus component of the getter.

A further alternative embodiment of the method of the present invention includes providing the silane and phosphorus source in the lamp envelope, sealing the envelope, heating the sealed envelope at a temperature and for a period of time sufficient to activate the silane component of the getter (but insufficient to convert the phosphorus source to phsophorus), and then energizing the coil to produce and activate the phosphorus component of the getter. This embodiment is particularly well-suited to use in an in-line manufacturing process in which lamp light-up is a necessary. In fact, the activation of the silane may be accomplished by ambient conditions in the manufacturing process without a separate heating step.

The silane component of the getter should be activated prior to lamp light-up because the temperature of the coil during lamp light-up will cause decomposition of silane before the desired gettering thereby occurs.

LAMP TEST DATA

The unexpected advantages of the present invention are more easily appreciated by the following test data for lamps including a silane getter, lamps including a phosphorus getter, and lamps including the combined getter of the present invention. A comparison of the results of these three lamp tests clearly demonstrates the significant advantages obtained by practice of the invention.

The increased efficiency of silane as a getter, relative to phosphorus, is described in U.S. patent application Ser. No. 153,863. The following example further illustrates the high gettering efficiency of silane relative to phosphorus.

A lamp test was conducted using two groups of 45 watt tungsten halogen lamps. Each lamp included a hard glass capsule having a 2.3 cubic centimeter internal volume and a 84 volt filament. One group contained phosphorus from the thermal decomposition of one percent phosphine in nitrogen introduced into the capsule at 925 torr. The second group, made without phosphorus, had 0.083 percent by volume silane in the fill gas. The silane-containing capsules were baked at 450° C. for three minutes before light-up. The basic fill gas composition for both groups was 0.1 percent hydrogen bromide, 5.0 percent nitrogen, and the balance xenon. Table I, which follows, shows the life results for the above-described lamps:

TABLE I

| | Phosphorus | 0.083% Silane |
|---|---|---|
| 1. Moles of getter | $1.15 \times 10^{-6}$ | $3.90 \times 10^{-7}$ |
| Relative Quantity | 1.00 | 0.34 |
| 2. No. Lamps | 21 | 44 |
| 3. Average Life (hours) | 1616 | 2344 |
| Standard Deviation | 447 | 706 |
| Minimum Life | 827 | 632 |
| Maximum Life | 2333 | 4627 |
| 4. Percent Life Gain | 0 (reference) | 46 |

The data contained in Table I show a 46 percent life gain with the use of silane, even though only about one third the stoichiometric amount of getter was present in those lamps.

The relationship between silane concentration and lamp life was studied in another test. These 45 watt capsules were similar to those represented in Table I.

Silane concentration was geometrically increased from 0.05 percent by volume to 0.2 percent by volume. A silane concentration greater than about one-quarter percent results in some capsule discoloration. Such discoloration is believed to be caused by elemental silicon (from excess silane remaining after reacting with any oxygen present). Capsule discoloration is unacceptable for many commercial lighting products due to the resultant decrease in lamp lumen output. Of course, such higher silane levels are acceptable in lamps used in applications where decreased lumen output is not a concern. The silane containing capsules were baked for three minutes at 450° C. before light-up.

Table II summarizes the lamp test data for lamps including various silane concentrations.

TABLE II

| | | SILANE LEVEL | | | |
|---|---|---|---|---|---|
| | P | 0.05% | 0.083% | 0.13% | 0.20%* |
| 1. Moles ($\times 10^{-7}$) | 11.5 | 2.4 | 3.9 | 6.1 | 9.4 |
| Relative Quantity | 1.00 | 0.21 | 0.34 | 0.53 | 0.82 |

TABLE II-continued

| | | SILANE LEVEL | | | |
|---|---|---|---|---|---|
| | P | 0.05% | 0.083% | 0.13% | 0.20%* |
| 2. No. of Lamps | 21 | 21 | 21 | 21 | 21 |
| 3. Average Life (Hrs) | 1945 | 2425 | 2492 | 2647 | 2617 |
| Standard Deviation | 804 | 500 | 438 | 428 | 434 |
| Minimum Life | 598 | 1101 | 1607 | 1910 | 1767 |
| Maximum Life | 3957 | 3190 | 3460 | 3340 | 3358 |
| 4. % Life Gain | 0 | +25 | +28 | +36 | +35 |

*% values represent percent by volume of fill gas

The test results summarized in Table II clearly show that the chemical type of getter used is far more important than the relative quantity of getter present with respect to lamp life attained. For example, in the 0.05 percent group, silane gave a 25 percent life increase relative to phosphorus, even though only one-fifth as much gettering agent was present stoichiometrically. The data also show that silane concentrations beyond an adequate amount (here approximately 0.13 percent) do not promote further increases in lamp life.

The optimum silane level in the fill gas of an incandescent lamp is affected by several parameters among which are internal volume, fill pressure, wall loading (watts per square centimeter of lamp surface), and total internal surface area of the lamp vessel and support structures. The important point being conveyed for the purpose of the present invention is that for any given lamp there is an optimum level of silane sufficient to getter all harmful contaminants in the lamp and above which there is no further expectable gain in life or possibly even a performance fall-off.

The demonstrated significant performance and life benefits afforded by the use of silane, relative to phosphorus are due to silane's superior ability to chemically getter or tie up harmful contaminants in the lamp atmosphere and the nonvolatile nature of the silicon dioxide formed. Also, while not wishing to be bound by theory, there is believed to be an ongoing gettering action promoted by traces of silicon halides which would form continually at the wall temperatures reached in operating tungsten halogen capsules. In light of this, it was completely unexpected that the addition of a less effective getter such as phosphorus to silane-gettered lamps would have any benefit whatsoever.

The simultaneous use of silane and phosphorus as the getter in incandescent lamps promotes a beneficial synergistic effect and a significant further filament life gain over either silane or phosphorus alone.

Table III shows the results of such a test, again using 45 watt tungsten halogen incandescent lamps including a 84 volt filament and a 2.3 cubic centimeter hard glass capsule.

The silane-containing lamps (0.083 volume percent silane) were baked at 450° C. for three minutes before light-up.

In the test lamps of the present invention, the getter was introduced into the lamp by a two-step process: first, phosphine contained in a stream of $N_2$ was introduced into a previously exhausted envelope, the coil was lighted to decompose the phosphine into phosphorus and hydrogen gas (which was pumped out of the unsealed envelope; and second, the silane was introduced into the envelope in mixture with the fill gas, and the envelope was sealed by conventional "tipping-off" techniques. The sealed lamps were then baked for three minutes at 450° C., after which heating step, they were lighted up. In each instance, the envelope was exhausted before introduction of the fill gas and/or getter.

TABLE III

| | Phosphorus | Silane | P & $SiH_4$ |
|---|---|---|---|
| 1. Moles ($\times 10^{-7}$) | 11.5 | 3.9 | (11.5 + 3.9) |
| Relative Quantity | 1.00 | 0.34 | 1.34 |
| 2. No. of Lamps | 30 | 18 | 12 |
| 3. Average Life (Hours) | 1818 | 2668 | 3325 |
| Standard Deviation | 791 | 464 | 444 |
| Minimum Life | 320 | 1332 | 2431 |
| Maximum Life | 3535 | 3375 | 4045 |
| 4. Percent Life Gain | 0 | 47 | 83 |

Some capsule discoloration was observed in each of the lamps in the combined getter test group of Table III after about 500 hours of operation. Such discoloration is believed to be the result of the amount of phosphorus used in the combined getter. A significant reduction in phosphorus content and/or an increase in halogen concentration in the lamp would correct the discoloration without adversely affecting lamp life.

The additional life increase for the getter combination is significant. A statistical "Student's t" test shows that there is less than one chance in 1,000 that the mean life of the combined getter group would differ so greatly from the silane-only group due to random (statistical sampling noise) effects. Also, the test results shown in Table II showed no hope of such an improvement by the mere increase of silane concentration in the fill gas.

The foregoing tests demonstrate the unexpected beneficial effect provided by the present invention. It appears that the phosphorus-silane combination will outperform either component alone regardless of their relative stoichiometric presence in the lamp. Most preferably, the amounts of the phosphorus-silane combination are selected to be within the limits of sufficient optical clarity to provide an efficient light source. Determination of such limits can be routinely determined by the skilled artisan.

A similar synergistic gettering effect would occur when phosphorus is used together with diborane on the higher boron hydrides. This expectation is based on the chemical similarities between the respective silicon hydrides and boron hydrides.

The present invention has been described in detail, including the preferred embodiments thereof. It will be appreciated that the skilled artisan, upon consideration of this disclosure, will be able to make modifications and/or improvements thereon, without departing from the spirit of the following claims.

What is claimed is:

1. A method of gettering an incandescent lamp comprising the steps of:

providing a getter comprising phosphorus and silane in an unsealed lamp envelope;

sealing the lamp envelope; and activating the phosphorus and silane contained in the sealed envelope.

2. A method in accordance with claim 1 wherein the activating source comprises heating the sealed envelope, for a sufficient period of time, and at a sufficient temperature, to activate the getter before the decomposition of the getter.

3. A method in accordance with claim 1 wherein phosphorus is initially included in the unsealed envelope as elemental phosphorus.

4. A method in accordance with claim 1 wherein the phosphorus is generated in situ by thermal decomposition of phosphine ($PH_3$) gas.

5. A method in accordance with claim 1 wherein the phosphorus source introduces phosphorus into the envelope in an amount from approximately $5\times10^{-5}$ to approximately $5\times10^{-9}$ moles of phosphorus per cubic centimeter lamp volume.

6. A method in accordance with claim 1 wherein the phosphorus is included in the envelope in an amount from approximately $5\times10^{-6}$ to approximately $5\times10^{-8}$ moles of phosphorus per cubic centimeter lamp volume.

7. A method in accordance with claim 1 wherein silane is included in the envelope in an amount from approximately 0.01 to approximately 0.5 percent by volume of the fill gas.

8. A method in accordance with claim 7 wherein silane is included into the envelope in an amount from approximately 0.1 to approximately 0.2 percent by volume of the fill gas.

9. A method of gettering an incandescent lamp comprising the steps of:

introducing a phosphorus source into an unsealed envelope;

treating the phosphorus source contained in the unsealed envelope to produce elemental phosphorus within the unsealed envelope;

introducing a fill gas and silane into the unsealed lamp envelope;

sealing the lamp envelope; and activating the elemental phosphorus and silane contained in the sealed envelope.

10. A method in accordance with claim 9 wherein the activating step comprises heating the sealed envelope, for a sufficient period of time, and at a sufficient temperature, to activate the phosphorus and silane before the decomposition thereof.

11. A method in accordance with claim 9 wherein the phosphorus source comprises phosphine ($PH_3$) gas.

12. A method in accordance with claim 9 wherein the phosphorus source introduces phosphorus into the envelope in an amount from approximately $5\times10^{-5}$ to approximately $5\times10^{-9}$ moles of phosphorus per cubic centimeter lamp volume.

13. A method in accordance with claim 9 wherein the phosphorus source introduces phosphorus into the envelope in an amount from approximately $5\times10^{-6}$ to approximately $5\times10^{-8}$ moles of phosphorus per cubic centimeter lamp volume.

14. A method in accordance with claim 9 wherein silane is introduced into the envelope in an amount from approximately 0.01 to approximately 0.5 percent by volume of the fill gas.

15. A method in accordance with claim 14 wherein silane is introduced into the envelope in an amount from approximately 0.1 to approximately 0.2 percent by volume of the fill gas.

16. An incandescent lamp comprising:

an envelope;

a tungsten filament mounted within the envelope;

a fill gas; and a getter comprising silane and phosphorus.

17. An incandescent lamp in accordance with claim 16 wherein the getter comprises silane in an amount from approximately 0.01 to approximately 0.5 volume percent of the fill gas and phsophorus in an amount from approximately $5\times10^{-5}$ to approximately $5\times10^{-9}$ moles of phosphorus per cubic centimeter lamp volume.

18. An incandescent lamp in accordance with claim 17 wherein the getter comprises silane in an amount from approximately 0.1 to approximately 0.2 volume percent of the fill gas and phosphorus in an amount from approximately $5\times10^{-6}$ to approximately $5\times10^{-8}$ moles of phosphorus per cubic centimeter lamp volume.

19. An incandescent lamp in accordance with claim 18 wherein the sealed envelope is mounted within an outer jacket.

20. An incandescent lamp in accordance with claim 19 wherein the outer jacket comprises a reflector with a lens sealed thereto.

21. An incandescent lamp in accordance with claim 20 wherein the reflector is a parabolic shaped reflector.

22. A tungsten halogen incandescent lamp comprising:

an envelope;

a tungsten filament mounted within the envelope;

a fill gas comprising a halogen, hydrogen and an inert gas; and a getter comprising silane and phosphorus.

23. An incandescent lamp comprising:

a sealed envelope;

a tungsten filament mounted within the envelope; and a fill gas;

a getter comprising silane and phosphorus being provided in the sealed envelope during manufacture of the lamp to getter impurities therein.

* * * * *